US006582273B2

(12) United States Patent
Chen

(10) Patent No.: US 6,582,273 B2
(45) Date of Patent: Jun. 24, 2003

(54) MUSIC BOX TRANSMISSION MECHANISM

(76) Inventor: Yu-Kai Chen, No. 2-2, Lane 15, Da-Hsing St., Tan-Shui Town, Taipei (TW)

( * ) Notice: Subject to any disclaimer, the term of this patent is extended or adjusted under 35 U.S.C. 154(b) by 0 days.

(21) Appl. No.: 10/053,539

(22) Filed: Nov. 2, 2001

(65) Prior Publication Data

US 2003/0087582 A1 May 8, 2003

(51) Int. Cl.[7] ..... A63H 1/00
(52) U.S. Cl. ..... 446/238; 446/175; 446/236
(58) Field of Search ..... 446/238, 175, 446/81, 298, 404, 358, 236, 265, 297, 303; 40/430, 429, 435, 414, 456, 455; 185/39, 37; 74/55

(56) References Cited

U.S. PATENT DOCUMENTS 4,573,939 A * 3/1986 Hoshino ..... 446/298
5,226,845 A * 7/1993 Wu ..... 40/414
5,617,658 A * 4/1997 Chen ..... 40/411
6,174,215 B1 * 1/2001 Shih ..... 40/410

* cited by examiner

*Primary Examiner*—Jacob K. Ackun
*Assistant Examiner*—Bena B. Mill

(57) ABSTRACT

A music box transmission mechanism for a music box includes a first rotating member having a power device and rotating in one direction, a second rotating member having a wavy track and rotating in an opposite direction to that of the first rotating member, a limiting frame fixed on the first rotating member, and a moving members limited in the limiting frame, disposed on the wavy track of the second rotating member and moving up and down upon moving with the first rotating member. Furthermore, when the first rotating member and the second rotating member engage with each other and rotate in opposite directions, a plurality of movable ornaments respectively limited in special frames fixed on the first rotation member are disposed on an asymmetric wavy track of the second rotating member and move up and down smoothly.

12 Claims, 4 Drawing Sheets

MUSIC BOX TRANSMISSION MECHANISM

FIELD OF THE INVENTION

The present invention relates to a music box transmission mechanism, and more particular, the present invention relates to a transmission mechanism, wherein a transmitting device can rotate along with a rotation disc and a plurality of movable rods disposed at the periphery of the rotation disc can move up and down upon moving with a movable rotor.

BACKGROUND OF THE INVENTION

Currently, various music box-incorporated ornamental display assemblies have been disclosed and have appeared on the market, such as carrousels or the like. These ornamental display assemblies are rotated or reciprocated by the drive mechanism of a wind-up music box mechanism through a transmission mechanism. However, conventional transmission mechanisms for use with wind-up music box mechanism are commonly complicated and expensive.

In addition, such kinds of devices are often provided with a plurality of decorative ornaments and may often be provided with a mechanism to cause the decorative ornament to move as the music drum rotates. The decorative ornament is usually mounted on a support member, which is associated with the drive mechanism to provide the movement to the decorative ornament.

In order to provide reciprocating movement or rotational movement to different decorative objects of the ornamental display assembly, it is known to use an output shaft of the music drum to provide the power source for the reciprocating movement of a decorative element and to make use of the unwinding phenomenon of spring to provide the rotational movement for a separate decorative ornament. When this concept is applied to a variety of movements of the decorative elements, separate drive mechanisms are required and the decorative elements must be laterally spaced apart on the ornamental display assembly. Such an arrangement inherently requires a complex drive system to provide the desired motion to the decorative ornaments and needs a larger space.

Accordingly, the toy maker has tried to miniaturize the turnabout and has presented a variety of turnabout toys capable of rotating and going up and down as the turnabout in the amusement field does and these toys are loved very much by many people regardless of adults and children. Taking our invention, U.S. Pat. No. 5,276,271 granted on Jan. 4, 1994, as an example, the music box at the bottom of a mount case thereof provides a driving unit with a shaft extending downward from the center of the cavity. Further, the security nut fastens to a main shaft by way of screw threads so as to hold a rotation disc together with an open end of the mount case such that the main shaft with a decoration umbrella at the upper part thereof may rotate with the shaft synchronously. The crux of the prior art resides in that a wavy cam ring is arranged in the upper housing cavity and a movable rod is disposed above each circumferential hold at the periphery of the rotation disc with a decoration article at the top thereof. The respective movable rod at the lower end thereof passes through the respective hold to engage with a ring and a follower means with inner threads so that each follower means contacts with the wavy cam when the rotation disc rotates the movable rods and the decoration articles rotate along with the rotation disc. Moreover, the movable rods move up and down due to the follower means at the lower end of respective movable rod moving along the wavy cam ring. Hence, the prior art can offer a rotation and an up and down movement, and many people develop various transmission mechanisms according to the prior art.

However, ordinary inventions always provide a sophisticate device and make the production cost increase greatly. Moreover, the total weight includes those of the movable rods and the decoration articles, which press on the wavy track, and usually can't move smoothly. Someone discloses a movable rod with an arm contacting with a contour on the wavy track, but the invention can't reduce the friction effectively or make movement smoothly; on the other hand, it induces a new problem about the torque. Hence, it is hard for the player to have a feeling like playing the actual turn-about while a toy with a device of the prior art is used.

SUMMARY OF THE INVENTION

It is one object of the present invention to provide a transmission mechanism for a music box ornament, which is simple in structure and inexpensive to manufacture.

It is another object of the present invention to provide an ornamental display assembly having decorative elements rotated in opposite directions, which are actuated by a common power source.

According to the present invention, a music box transmission mechanism comprises a first rotating member having a power device and rotating in one direction, a second rotating member having a wavy track and rotating in an opposite direction to that of the first rotating member, a limiting frame fixed on the first rotating member, and a moving members limited in the limiting frame, disposed on the wavy track of the second rotating member and moving up and down upon moving with the first rotating member.

Certainly, the power device can be a music producing and driving unit having a first shaft on the top thereof, a second shaft on the bottom thereof, and a stirring wheel.

Certainly, the power device can have a top shaft on the top thereof, a bottom shaft thereof on the bottom, and a stirring wheel, and the first rotating member comprises a plurality of fixing devices and a rotation disc having a central through hole to be passed by the first shaft and a plurality of peripheral through holes for respectively securing the fixing devices.

Certainly, the respective fixing device can have a stop ring at the intermediate thereof and extends upward a cylindrical section and downward a decorative section; and the radius of the cylindrical section is larger than the radius of the symmetric through hole of the rotation disc.

Certainly, the second rotating member may comprise a transmitting shaft having a driving gear and extending outward from the power device, a cap-like cam having an asymmetric wavy track and a central fitting hole, and a driven gear meshing with the driving gear and fixed below the cap-like cam.

Certainly, the asymmetric wavy track may provide a contour with a continuous slant surface.

Certainly, the asymmetric wavy track could provide a longer path while the moving member is traveling upwards than that while the moving member is traveling downwards.

Certainly, the moving member can comprise a movable rod passing through a fixing device of the first rotating member, an upper link having a ball and a stick passing therethrough and disposed on the top part of the movable rod, and a decorative article at the lower part of the movable rod.

Certainly, the limiting frame can have a limiting through hole passing therethrough a stick of the moving member and is fixed on the first rotating member to prevent the moving member from shifting horizontally.

Certainly, the first rotating member and the second rotating member can be connected by a connecting rod and rotate in opposite directions.

Certainly, the second rotating member can have a cap-like cam having a uniform thickness to prevent the cap-like cam from deformation.

Certainly, the first rotating member may be disposed on a base foundation including a fixing nut locked in a bottom shaft of the power source and rotates in one direction.

Certainly, the base foundation can have an upper part thereof connected to the fixing nut, and a lower part thereof providing a stationary base to support the first rotating member and the second rotating member.

The present invention may best be understood through the following description with reference to the accompanying drawings, in which:

DETAILED DESCRIPTION OF THE PREFERRED EMBODIMENTS

Figure 1:
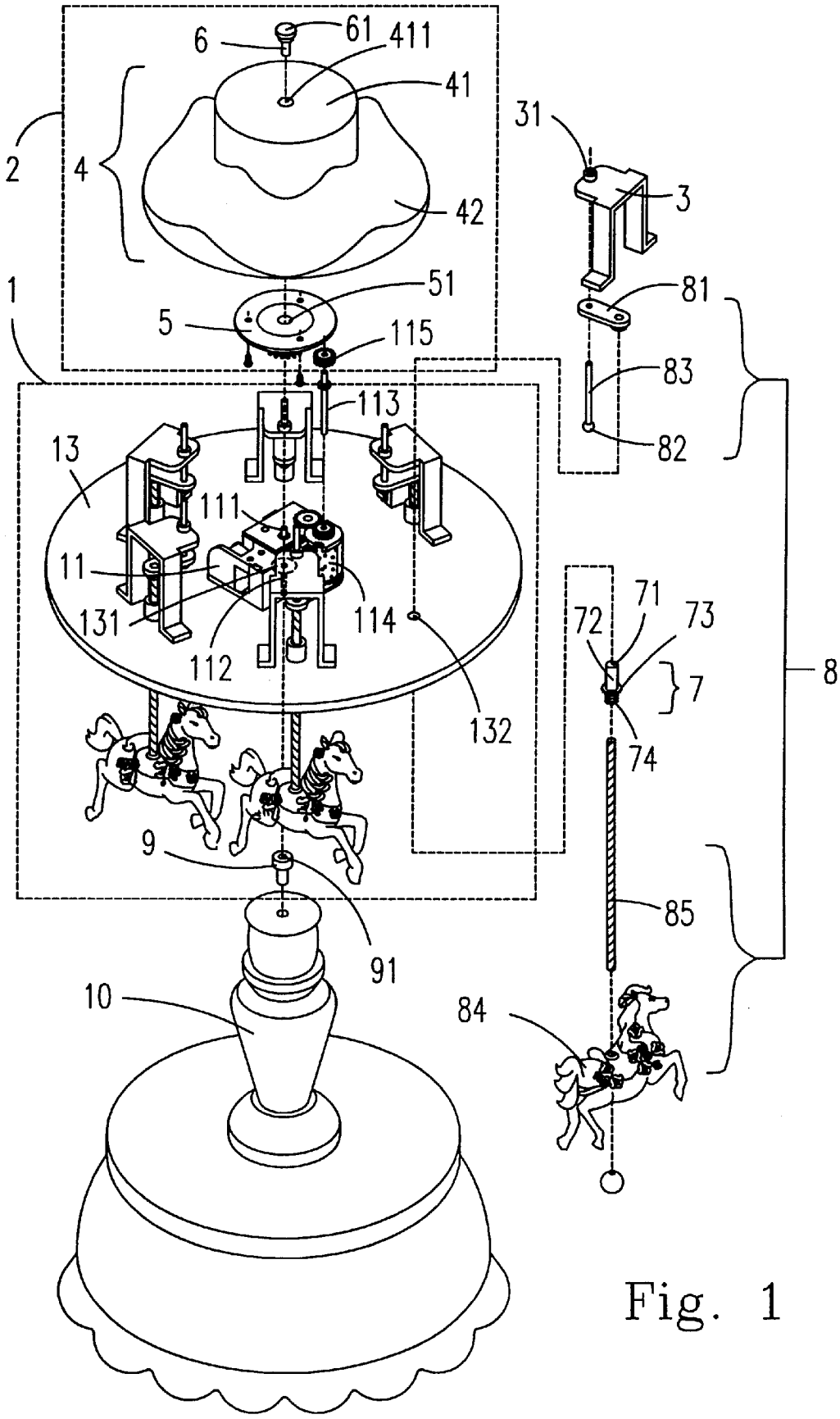
FIG. 1 is an exploded perspective view of a music box transmission mechanism according to the present invention.
Figure 2:
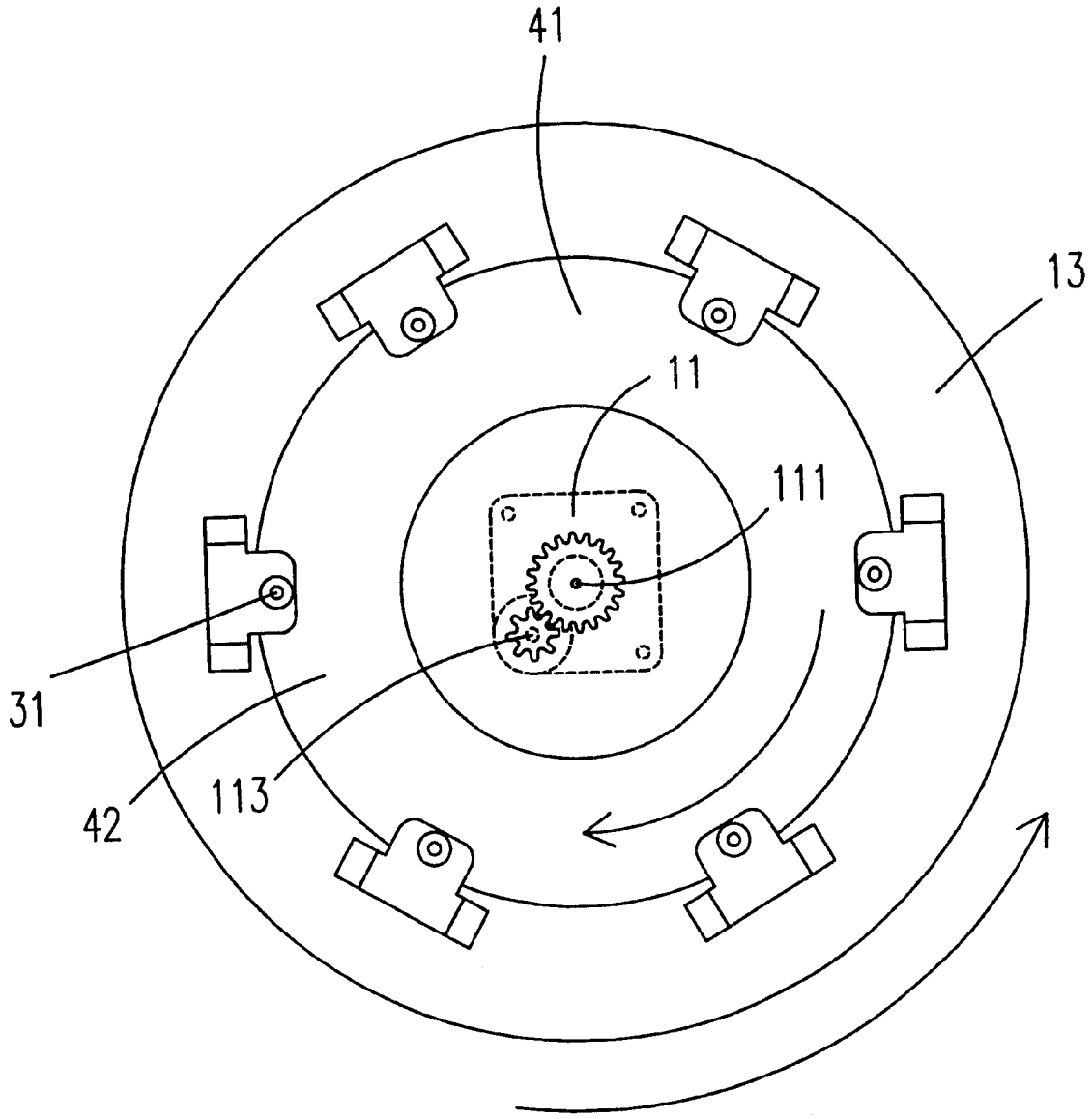
FIG. 2 is a top view of the transmission mechanism shown in FIG. 1 after assembled.
Figure 3:
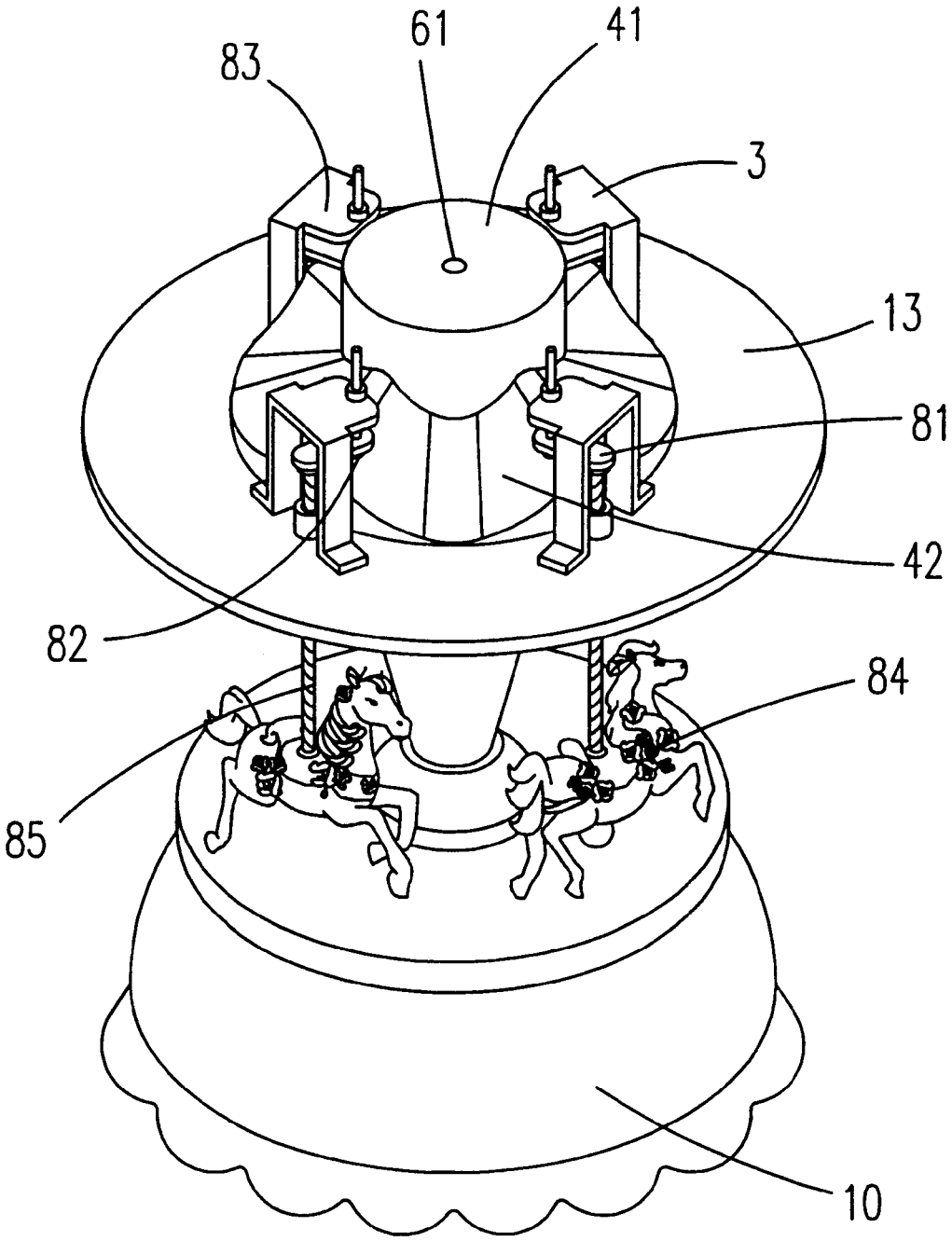
FIG. 3 is an assembled perspective view of the transmission mechanism shown in FIG. 1.

Referring to FIGS. 1 to 3, a music box transmission mechanism according to the present invention basically comprises a first rotating member 1 having a music producing and driving unit 11, a second rotating member 2, and a base foundation 10 including a fixing nut 9.

Wherein, the first rotating member 1 furthermore comprises a music producing and driving unit 11, a rotation disc 13, and a plurality of fixing devices 7. The music producing and driving unit 11 is a moving source and a shaft 112 extends downward from the bottom thereof to fixedly engage with the fixing nut 9 through the rotation disc 13. The producing and driving unit 11, as shown in the figures, may be a conventional music bell, wherein a conventional shaft corresponds to a top shaft 111, a bottom shaft 112 and a stirring wheel 114 disposed beside of the shaft 111. Moreover, the rotation disc 13 of the first rotating member 1 is circular and at the center thereof, there is fixed the producing and driving unit 11. The rotation disc 13 provides an axial hole 131 to be passed through by the shaft 112. Besides, the rotation disc 13 at the circumferential rim thereof provides a plurality of locating holes 132 to fasten fixing devices 7 respectively.

The second rotating member 2 furthermore comprises a transmitting shaft 113, having a driving gear 115 and extending outward from the stirring wheel 114 of the music producing and driving unit 11, a connecting rod 6, a cap-like cam 4 having an asymmetric wavy track 42 and a central fitting hole 411, and a driven gear 5 meshing with the driving gear 115 and fixed below the cap-like cam 4. Wherein, the cap-like cam 4 is cap-shaped with an upper cylindrical head 41 and a central fitting hole 411. The cap-like cam 4 at the periphery thereof provides an asymmetric wavy track 42 with a tardy-up-and-rapid-down contour. Besides, a driven gear 5 is fixedly attached to the bottom wall of the cylindrical head 41 such that a central through hole 51 of the driven gear 5 can be aligned with the fitting hole 411. Then, a connecting rod 6 having an upper fitting end 61 for enabling the connecting rod 6 to be retained on the cap-like cam 4 passes through the aligned holes 411, 51 to connect with the shaft 111 such that the driven gear 5 can mesh with the driving gear 115 and the entire cap-like cam 4 can be movably mounted above the rotation disc 13.

The fixing nut 9 has an upper central hole 91 receiving therein the shaft 112. The lower part of the fixing nut 9 is fixed to the base foundation 10.

According to the present invention, the moving member 8 furthermore comprises a movable rod 85, a conventional decorative article 84, and an upper link 81 passing therethrough a ball 82 and a stick 83. Wherein, each movable rod 8 is inserted into each fixing device 7 and links a link 81 with a ball 82 fixed to a stick 83 passing therethrough. The respective movable rod 8 at the lower end thereof may connect the conventional decorative article 84. In addition, a fixing frame 3 fixed on the rotation disc 13 and set above the fixing device 7 provides a through hole 31 passing therethrough the stick 83. Furthermore, the fixing frame 3 provides a clamping part at the top thereof to prevent the attached link 81 from moving horizontally.

Figure 4:
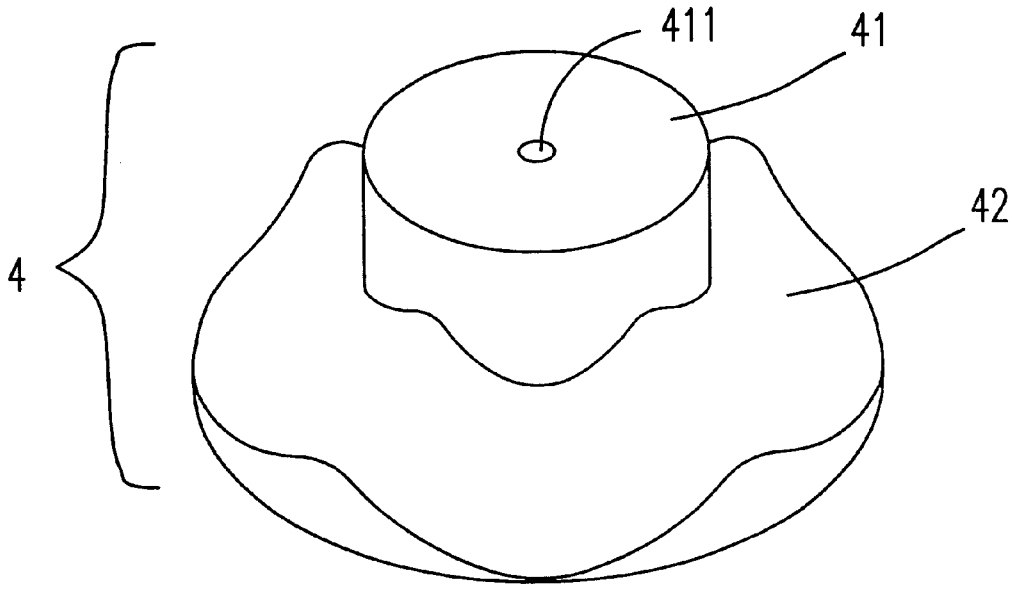
FIG. 4 is a perspective view of a movable cap-like cam in the transmission mechanism according to the present invention.
Figure 5:
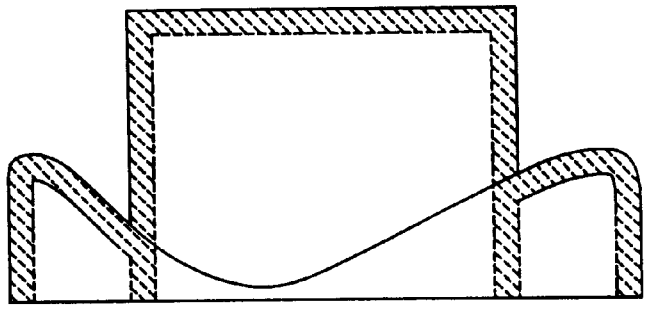
FIG. 5 is a side view of the movable cap-like cam shown in FIG. 4.

Referring to FIGS. 1, 4, and 5, the contour on the asymmetric wavy track 42 can be provided with a plurality of tardy-up-and-rapid-down sub-contours such that the decorative article 84 under the movable rod 8 can provide flexible modes of up and down movements as desired.

Referring to FIGS. 1 to 3, each component in the transmission mechanism of the present invention has been disclosed in the preceding descriptions and a complete appearance of the transmission mechanism is shown in FIG. 3 as soon as these components are assembled. Once a music bell is used as the music producing and driving unit 11, the rotation disc 13 being turned in a counterclockwise direction may tighten up the spring in the music bell because the producing and driving unit 11 is disposed at the center of the rotation disc 13 and the shaft 112 is locked in the base foundation 10. Next, the rotation disc 13 and driving unit 11 rotate in the clockwise direction due to the resilient force of the tightened spring. In the mean time, the transmitting shaft 113 and the driving gear 115 may rotate synchronously. Hence, the driven gear 5, which meshes with the driving gear 115, is forced to rotate counterclockwise. Because the driven gear 43 is fixed to the movable cap-like cam 4, the movable cap-like cam 4 rotates in a direction opposite to that of the rotation disc 13. It is noted that the arrangement is helpful for the attached ball 82, the stick 83 and upper link 81 guided by the fixing frame 3 to free from the influence of the friction and torque force while the attached balls 82 displace along the asymmetric way track 42 and the movable rods 85 move up and down in the respective guide frames. In this way, the decorative article at the lower end of the movable rod 85 ascends and descends accordingly to perform a rotation as well as a movement of going up and down.

It is appreciated from the preceding descriptive explanations of preferred embodiments that the music box transmission mechanism according to the present invention provides simplified component parts to make the assembly job be accomplished in a fast manner so as to lower down the production cost greatly.

Although the present invention has been described and illustrated in detail, it is to be clearly understood that the same is by ways of illustrations and examples only and is not to be taken by way of limitations, the spirit and scope of the present invention being limited only by the terms of the appended claims.

What is claimed is:

1. A music box transmission mechanism, comprising:

a first rotating member having a power device and rotating in one direction;

a second rotating member having a wavy track and rotating in an opposite direction to that of said first rotating member;

a limiting frame fixed on said first rotating member;

a moving member limited in said limiting frame, disposed on said wavy track of said second rotating member and moving up and down upon moving with said first rotating member, wherein said power device has a top shaft on the top thereof, a bottom shaft on the bottom thereof, and a stirring wheel, and said first rotating member comprises a plurality of fixing devices and a rotation disc having a central through hole to be passed by said bottom shaft and a plurality of peripheral through holes for respectively securing said fixing devices.

2. The music box transmission mechanism according to claim 1, wherein said power device further comprises a music producing unit.

3. The music box transmission mechanism according to claim 1, wherein each of said plurality of fixing devices has a stop ring disposed at an intermediate part thereof, a cylindrical section extending upward from the stop ring, and a decorative section extending downward from the stop ring; and wherein a radius of said cylindrical section is larger than a radius of a corresponding through hole of said plurality of peripheral through holes of said rotation disc.

4. The music box transmission mechanism according to claim 1, wherein said second rotating member comprises a transmitting shaft having a driving gear and extending outward from said power device, a cap-like cam having an asymmetric wavy track and a central fitting hole, and a driven gear meshing with said driving gear and fixed below said cap-like cam.

5. The music box transmission mechanism according to claim 4, wherein said asymmetric wavy track provides a contour with a continuous slant surface.

6. The music box transmission mechanism according to claim 5, wherein said asymmetric wavy track provides a longer path while said moving member is travelling upwards than that while said moving member is travelling downwards.

7. The music box transmission mechanism according to claim 1, wherein said moving member comprises a movable rod extending through a corresponding fixing device of said plurality of fixing devices of said first rotating member, an upper link having a ball and a stick passing therethrough and disposed on a top part of said movable rod, and a decorative article connected to a lower part of said movable rod.

8. The music box transmission mechanism according to claim 1, wherein said limiting frame has a limiting through hole, and said moving member includes a stick extending through the limiting through hole and is fixed on said first rotating member to prevent said moving member from shifting horizontally.

9. The music box transmission mechanism according to claim 1, wherein said first rotating member and said second rotating member are connected by a connecting rod and rotate in opposite directions.

10. The music box transmission mechanism according to claim 1, wherein said second rotating member has a cap-like cam having a uniform thickness to prevent said cap-like cam from deformation.

11. The music box transmission mechanism according to claim 1, wherein said first rotating member is disposed on a base foundation including a fixing nut locked on a bottom shaft of said power device.

12. The music box transmission mechanism according to claim 11, wherein said base foundation has an upper part thereof connected to said fixing nut, and a lower part thereof providing a stationary base to support said first rotating member and said second rotating member.

* * * * *